US005148459A

United States Patent [19]

Yahata

[11] Patent Number: 5,148,459

[45] Date of Patent: Sep. 15, 1992

[54] POWER SOURCE DEVICE FOR X-RAY SYSTEM

[75] Inventor: Mitsuru Yahata, Ootawara, Japan

[73] Assignee: Kabushiki Kaisha Toshiba, Kawasaki, Japan

[21] Appl. No.: 807,645

[22] Filed: Dec. 16, 1991

Related U.S. Application Data

[63] Continuation of Ser. No. 586,379, Sep. 21, 1990, abandoned, which is a continuation of Ser. No. 251,600, Sep. 30, 1988, abandoned.

[30] Foreign Application Priority Data

Sep. 30, 1987 [JP] Japan ..... 62-243904

[51] Int. Cl.[5] ..... H05G 1/20

[52] U.S. Cl. ..... 378/105; 378/101

[58] Field of Search ..... 378/105, 201, 101

[56] References Cited

U.S. PATENT DOCUMENTS

| | | | |
|---|---|---|---|
| 2,400,750 | 5/1946 | Gage . | |
| 4,117,334 | 9/1978 | Strauts | 378/105 |
| 4,247,782 | 1/1981 | Muraki | 378/201 |
| 4,601,051 | 7/1986 | Santurnun et al. . | |

FOREIGN PATENT DOCUMENTS

| | | |
|---|---|---|
| 2908767 | 9/1980 | Fed. Rep. of Germany . |
| 724769 | 5/1932 | France . |

*Primary Examiner*—Craig E. Church

*Attorney, Agent, or Firm*—Finnegan, Henderson, Farabow, Garrett and Dunner

[57] ABSTRACT

In a power source device for X-ray system, circuit units are mounted on chassises, respectively and chassises are fixed in a casing and are electrically insulated from the casing by insulative members. The circuit units are electrically connected through a cable to a ground terminal of the casing which is connected to the ground. The chassises are also connected through a cable to a ground terminal of a panel board which is connected to the ground.

7 Claims, 2 Drawing Sheets

POWER SOURCE DEVICE FOR X-RAY SYSTEM

This application is a continuation of now abandoned application Ser. No. 586,379, filed Sep. 21, 1990, which in turn is a continuation of abandoned application Ser. No. 251,600, filed Sep. 30, 1988.

BACKGROUND OF THE INVENTION

1. Field of the Invention

The present invention relates to a power source device for an X-ray system, particularly, to a device capable of suppressing the current leakage to the casing of the device.

2. Description of the Related Art

A power source device for an X-ray system comprises in general a rectifying/smoothing circuit for converting an AC voltage to a rectified smooth voltage and a high voltage circuit for boosting the rectified smooth voltage to a high voltage for application to an X-ray tube. These rectifying/smoothing circuit and high voltage circuit are separately assembled within metal chassis, and these chassis are housed in a metal casing so as to form a power source device.

The chassis itself is electrically connected in general to the casing. The ground potential point of the rectifying/smoothing circuit is connected to the ground potential point of the high voltage circuit and to the ground terminal of the casing via a ground cable. The ground terminal is connected to the casing and to the ground terminal connected to the ground potential point of an external panel board via the ground cable.

A medical instrument such as an X-ray device is brought into contact with a human body directly or indirectly, leading to requirement of a complete guarantee of safety for protecting the patient, attendant and operator from electrical shocks. The medical instrument, e.g., X-ray device, is designed under the safety standard set for the medical instrument. The current leakage to the casing is specified in the safety standard. It is specified that a current meter should be connected between the ground terminal of the casing and the casing and that the current flowing through the current meter should be held below a certain level.

In the conventional X-ray device, the current leakage to the casing can be controlled to meet the safety standard because of the measure for connection to the ground potential point described above. In an X-ray device employing a power source circuit of a high frequency inverter system, however, the current leakage to the casing is several times to tens of times as large as in the conventional X-ray device, making it difficult to meet the safety standard without fail.

SUMMARY OF THE INVENTION

An object of the present invention is to provide a power source device for an X-ray device capable of suppressing the current leakage to the casing.

According to the present invention, there is provided a power source device for applying a high voltage to an X-ray tube, comprising:

a first circuit unit for converting a power source voltage to a high frequency voltage;

a second circuit unit for boosting the high frequency voltage to a high voltage suitable for application to the X-ray tube;

a casing in which the first and second circuit units are fixed in an electrically insulated manner; and means for connecting the first and second circuit units to the ground.

DESCRIPTION OF THE PREFERRED EMBODIMENT

Figure 1:
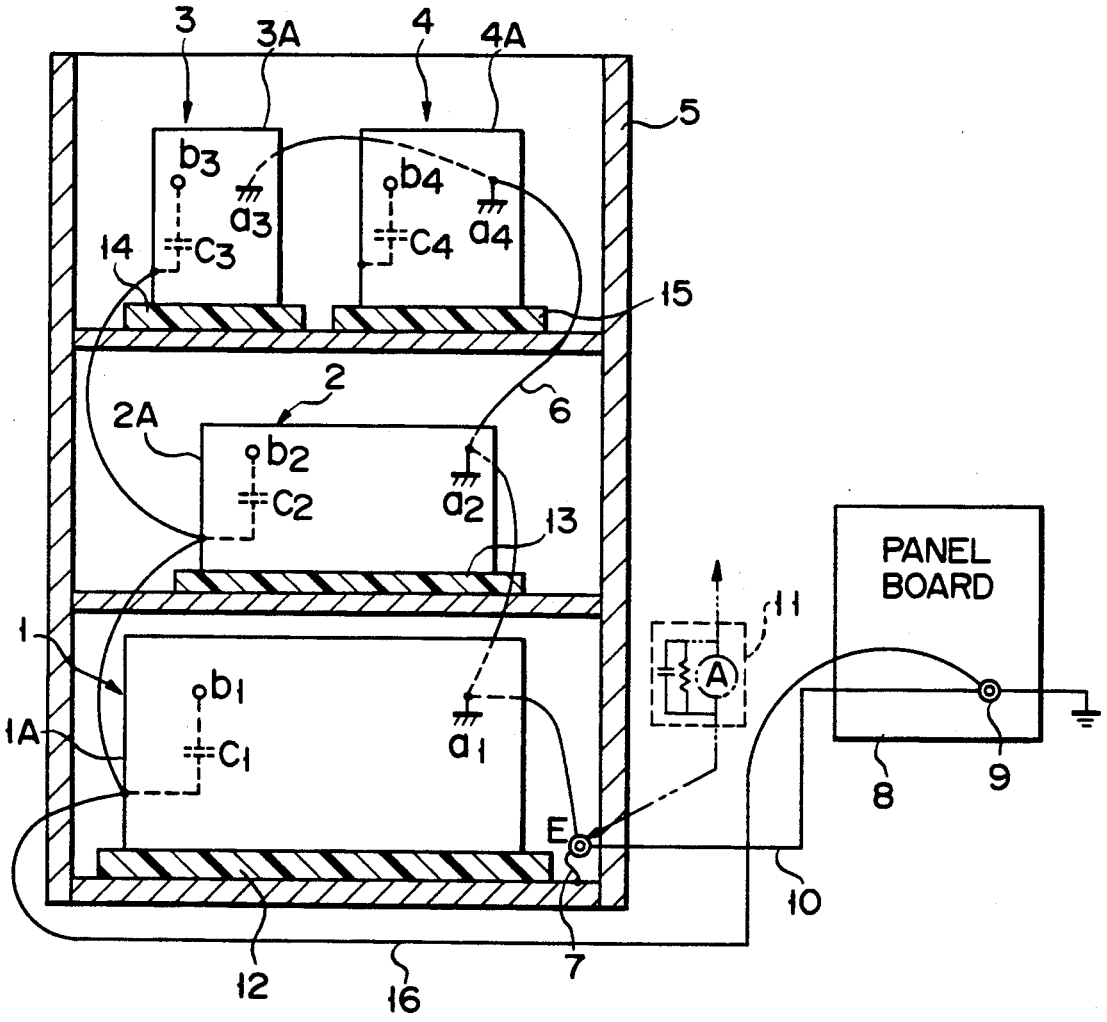
FIG. 1 is a cross sectional view schematically showing the construction of a power source device for an X-ray device according to one embodiment of the present invention.

As shown in FIG. 1, the power source device for an X-ray device according to one embodiment of the present invention comprises a high voltage circuit unit 1, an inverter circuit unit 2, a chopper circuit unit 3 and a rectifying/smoothing circuit unit 4. These circuit units 1, 2, 3, 4 are respectively mounted on metal chassis 1A, 2A, 3A and 4A. Further, these chassis are supported on insulating members 12, 13, 14, 15 formed of thermosetting phenolic resin and disposed within a metal casing 5. These insulating members permit the metal chassis 1A, 2A, 3A and 4A to be electrically insulated from the casing 5.

The ground potential points $a_1$, $a_2$, $a_3$, $a_4$ of these high voltage circuit unit 1, inverter circuit unit 2, chopper circuit unit 3 and rectifying/smoothing circuit unit 4 are connected to each other via a ground cable 6 which is connected to the ground terminal E of the casing 5. The ground terminal E is connected to the casing 5 via a ground cable 7 and to a ground terminal 9 via a ground cable 10. The ground terminal 9 is connected to the ground of a panel board 8. Further, the chassis 1A, 2A, 3A, 4A are connected to each other and to the ground terminal 9 of the panel board 8 via a ground cable 16.

Figure 2:
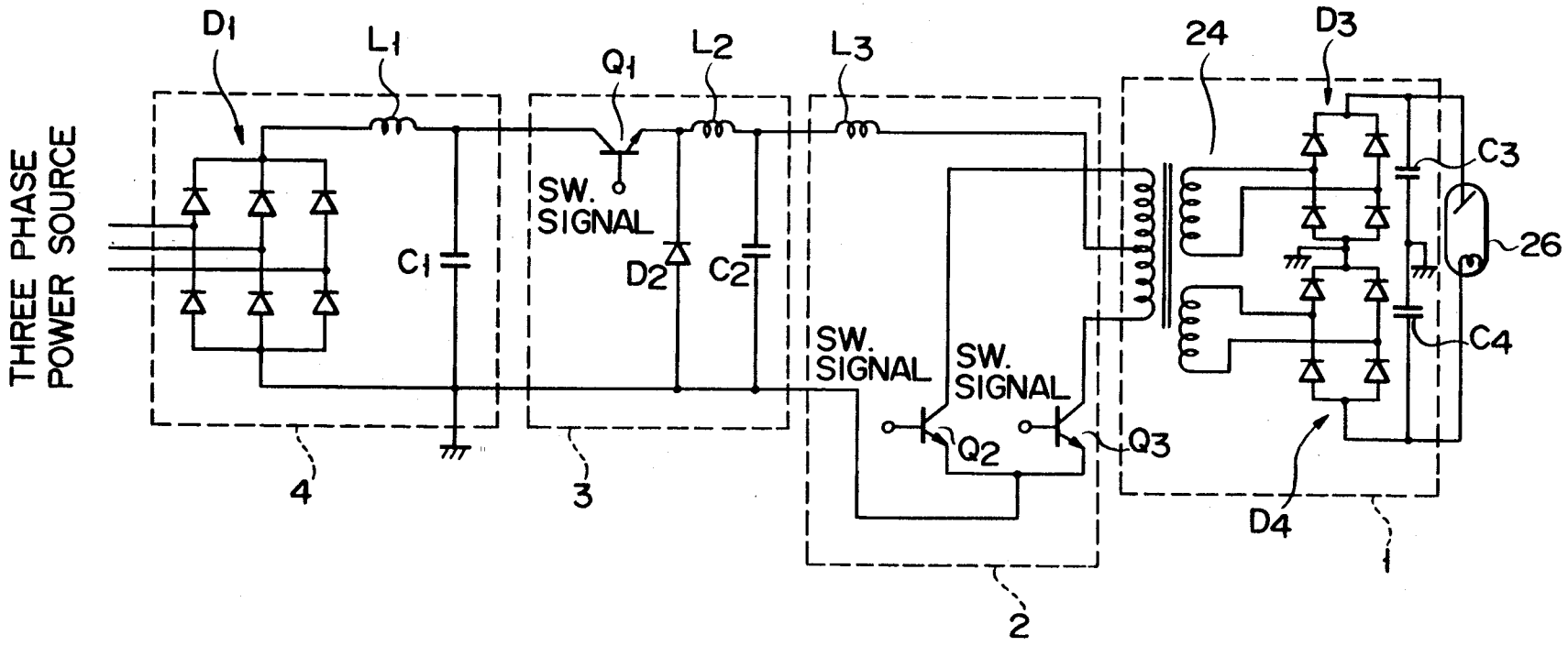
FIG. 2 is a block diagram showing as an example the circuit of the power source device shown in FIG. 1.

The electric circuit of the power source device shown in FIG. 1 is constructed as shown in, for example, FIG. 2. It is seen that a three-phase AC power is supplied to a rectifying circuit D1 included in the rectifying/smoothing circuit unit 4. The rectifying circuit D1 is formed by bridge-connecting a plurality of diodes. The rectified output voltage from the rectifying circuit D1 is smoothed by a coil L1 and a capacitor C1 both connected to the rectifying circuit D1. Connected to the rectifying/smoothing circuit unit 4 is the chopper circuit unit 3 consisting of a transistor Q1, a fly-wheeling diode D2, a capacitor C2 and a coil L2. The rectified smooth voltage is adjusted within the chopper circuit unit 3 in accordance with the switching pulse signal supplied to the base of the transistor Q1. To be more specific, the rectified smooth voltage is chopped by the transistor Q1, and the chopped voltage signal is filtered by a filter circuit consisting of the capacitor C2 and the coil L2, with the result that an adjusted DC voltage is generated from the chopper circuit unit 3.

An inverter unit 2 comprising a coil L3 and transistors Q2, Q3 is connected between the chopper circuit unit 3 and a high voltage circuit 1. The coil L3 is connected between the coil L2 in the chopper circuit unit 3 and the intermediate tap on the primary winding side of a transformer 24 included in the high voltage circuit unit 1. On the other hand, the transistors Q2, Q3 are connected to the primary winding of the transformer 24. The junction between these transistors is connected to the chopper circuit unit 3 on the ground potential side. If switching pulse signals of opposite phases are supplied to these transistors Q2, Q3, the adjusted DC voltage of opposite phase is applied to the primary winding of the transistor 24 via the tap in accordance with the switching pulse signal. As a result, a boosted high frequency AC voltage is generated on the secondary winding of the transformer 24 within the high voltage circuit unit 1. The high frequency AC voltage thus generated is rectified within the high voltage circuit unit 1 by diode bridges D3 and D4 and, then, smoothed by capacitors C3, C4. It follows that the smoothed high voltage is applied between the anode and the filament of an X-ray tube 26.

In the power source device shown in FIG. 1, stray capacitances C1, C2, C3, C4 are produced between the chassis 1A, 2A, 3A, 4A and points $b_1$, $b_2$, $b_3$, $b_4$, differing in potential level from the ground potential in the high voltage circuit unit 1, inverter circuit unit 2, chopper circuit unit 3, and rectifying/smoothing circuit unit 4, respectively. These stray capacitances tend to cause current to leak from the circuit units 1, 2, 3, 4 to the chassis 1A, 2A, 3A, 4A and, then, to the casing 5, with the result that an electric shock is given to the person touching the casing 5. The current leakage is particularly prominent in the case where a high frequency AC voltage is generated within the high voltage circuit unit 1, inverter circuit unit 2, chopper circuit unit 3 and rectifying/smoothing circuit 4, as in the circuit shown in FIG. 2. To be more specific, the impedance of the stray capacitances C1, C2, C3, C4 is lowered with increase in the frequency of the AC voltage, leading to the prominent current leakage noted above. In the present invention, however, the chassis 1A, 2A, 3A and 4A are electrically insulated from the casing 5. In addition, these chassis are connected to each other via the ground cable 16 which is connected to the ground terminal 9 of the panel board 8. It follows that the leaking current between the casing 5 and the ground terminal E, which is measured by a current meter 11, can be held lower than specified in the safety standard, leading to an improved safety of the X-ray device.

What is claimed is:

1. A power source device for applying a high voltage to an X-ray tube, comprising:

a high voltage circuit unit, a high frequency inverter circuit unit, a chopper circuit unit and a rectifying/smoothing circuit unit, each said circuit unit being electrically connected, having a ground potential point, and being mounted on an individual metal chassis;

a metal casing in which each said metal chassis is supported;

a ground terminal for and electrically connected to said metal casing;

an electrically insulating member disposed between each said metal chassis and said metal casing for electrically insulating each said metal chassis from said metal casing;

a first ground cable for connecting each said ground potential point of each said circuit unit to the ground terminal of said metal casing;

a panel board for supplying a power source voltage from a voltage supply, said panel board having a ground terminal;

a second ground cable connecting the chassis of said circuit unit to the ground terminal of said panel board; and a third ground cable connecting the ground terminal of said casing to the ground terminal of said panel board.

2. The power source device of claim 1, wherein said voltage supply means includes means for supplying three-phase AC power to a rectifying circuit of said rectifying/smoothing circuit unit.

3. The power source device of claim 2, wherein said rectifying circuit of said rectifying/smoothing circuit unit includes a plurality of bridge-connected diodes.

4. The power source device of claim 3, wherein a smoothing circuit of said rectifying/smoothing circuit unit is provided for smoothing a rectified output voltage from said rectifying circuit, said smoothing circuit including a coil and associated capacitor both electrically connected to said rectifying circuit.

5. The power source device of claim 4, wherein said chopper circuit unit includes in electrical connection a transistor, a fly-wheel diode, a capacitor and a coil.

6. The power source device of claim 5, wherein a rectified, smoothed voltage from said rectifying/smoothing circuit unit is introduced to and adjusting within said chopper circuit unit including being chopped by said transistor and thereafter filtered by a filter circuit including said capacitor and said coil of said chopper circuit unit.

7. The power source device of claim 6, wherein said inverter circuit unit includes a coil and two electrically connected transistors, with said inverter circuit unit being electrically connected between said chopper circuit and said high voltage circuit unit.

* * * * *

UNITED STATES PATENT AND TRADEMARK OFFICE

CERTIFICATE OF CORRECTION

PATENT NO. : 5,148,459

DATED : September 15, 1992

INVENTOR(S) : Mitsuru YAHATA

It is certified that error appears in the above-identified patent and that said Letters Patent is hereby corrected as shown below:

Claim 1, column 4, line 15, change "said" to --each--.

Claim 4, column 4, line 32, change "associated" to --associate--.

Claim 6, column 4, line 39, change "adjusting" to --adjusted--.

Signed and Sealed this

Eleventh Day of January, 1994

*Attest:*

*Attesting Officer*

Bruce Lehman

BRUCE LEHMAN

*Commissioner of Patents and Trademarks*